US007191475B1

(12) United States Patent
Marcotte

(10) Patent No.: US 7,191,475 B1
(45) Date of Patent: Mar. 20, 2007

(54) RETRACTABLE SHOWERHEAD

(76) Inventor: Lewis R. Marcotte, 56978 Cedar Rd., Osceola, IN (US) 46561

( * ) Notice: Subject to any disclaimer, the term of this patent is extended or adjusted under 35 U.S.C. 154(b) by 111 days.

(21) Appl. No.: 10/801,631

(22) Filed: Mar. 16, 2004

Related U.S. Application Data

(60) Provisional application No. 60/455,764, filed on Mar. 19, 2003.

(51) Int. Cl.
*A47K 3/20* (2006.01)

(52) U.S. Cl. ..... 4/567; 4/615

(58) Field of Classification Search ..... 4/567–570, 4/615; 137/801
See application file for complete search history.

(56) References Cited

U.S. PATENT DOCUMENTS 6,381,770 B1 * 5/2002 Raisch ..... 4/570
2004/0010848 A1 * 1/2004 Esche ..... 4/675
2004/0216789 A1 * 11/2004 Benstead et al. ..... 137/801

* cited by examiner

*Primary Examiner*—Charles E. Phillips
(74) *Attorney, Agent, or Firm*—James D. Hall

(57) ABSTRACT

A showerhead is connected to a length of flexible weighed hose which is run through the shower wall. The showerhead may be pulled away from the wall and the hose extended out from the wall accordingly. When showerhead is replaced in a bracket against the wall the hose retracts back inside the wall.

1 Claim, 3 Drawing Sheets

RETRACTABLE SHOWERHEAD

CROSS-REFERENCE TO RELATED APPLICATION

This is a continuation of and claims priority from provisional application Ser. No. 60/455,764, filed Mar. 19, 2003.

FIELD OF THE INVENTION

The invention herein pertains to the residential plumbing art. More specifically the invention relates to a showerhead.

BACKGROUND OF THE INVENTION

In a shower it is desirable to have a showerhead that can be moved about in order to direct the water coming out of the showerhead to different areas. In order to accomplish this it is customary to have a head part removably supported by a bracket on a wall with a length of flexible hose or tubing extending between the head part and the water source. This arrangement can be cumbersome because of the exposed length of tubing hanging down within the shower stall.

SUMMARY OF THE INVENTION

The invention disclosed herein includes a detachable weighted head part mountable on a wall bracket. A length of weighted flexible hose connects the head part with a water source. The length of hose is located behind the shower stall wall and extends through the wall to the head part. When the head part is removed from its wall bracket for use, the hose is pulled from the exterior of the wall. When the head part is replaced, the hose retracts back into the wall.

Accordingly, it is an object of this invention to provide a retractable showerhead which is of economical construction and ease of operation.

BRIEF DESCRIPTION OF THE DRAWINGS

This and other objects of the invention will be more apparent from the description below and the drawings in which.

DETAILED DESCRIPTION OF THE PREFERRED EMBODIMENTS

Figure 1:
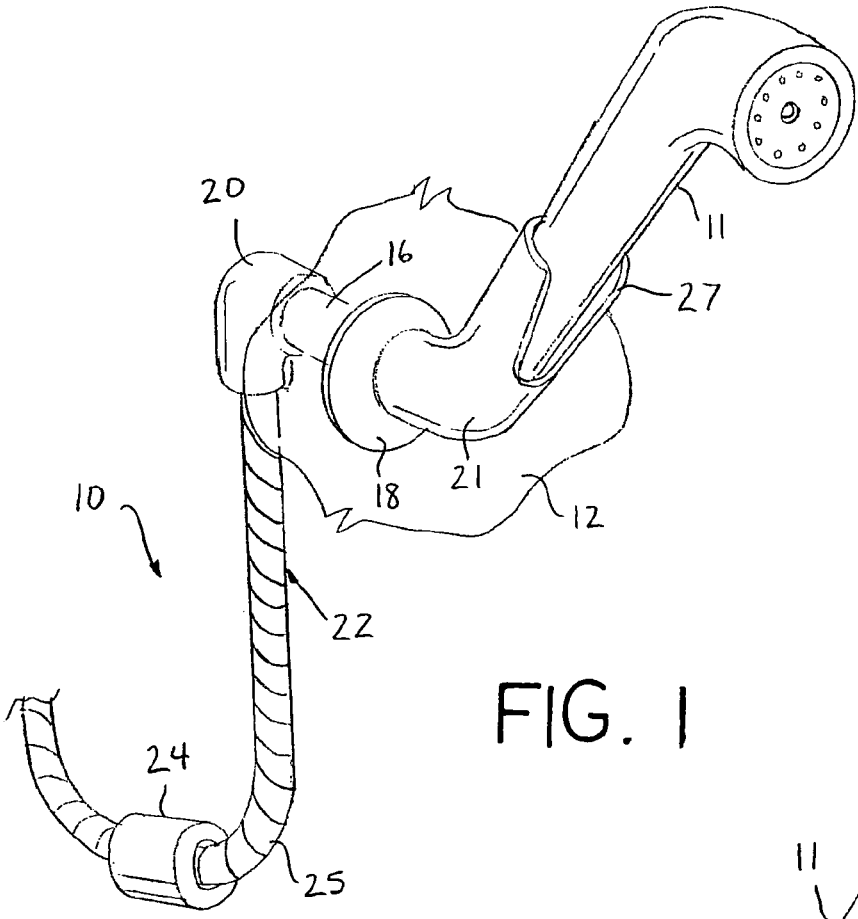
FIG. 1 is a fragmentary perspective view of the retractable showerhead.
Figure 2:
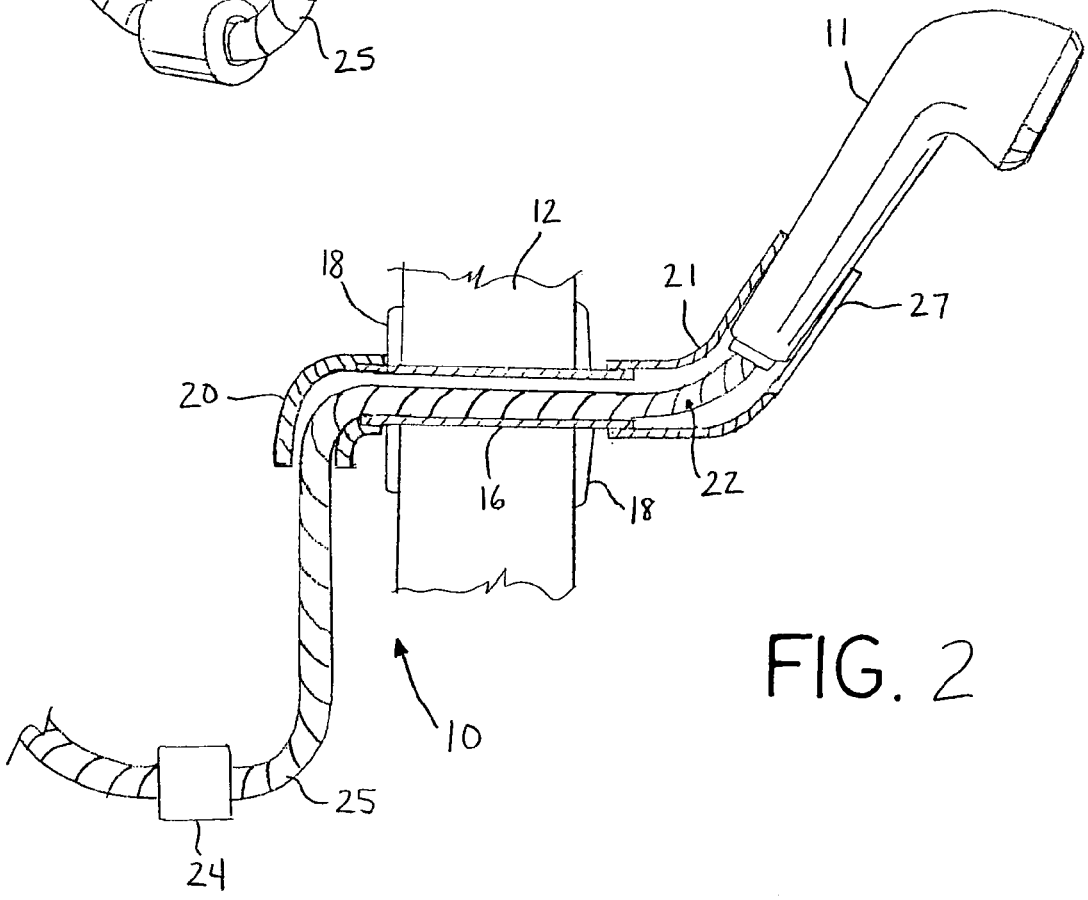
FIG. 2 is a sectional side view of the retractable showerhead as seen in FIG. 1.
Figure 3:
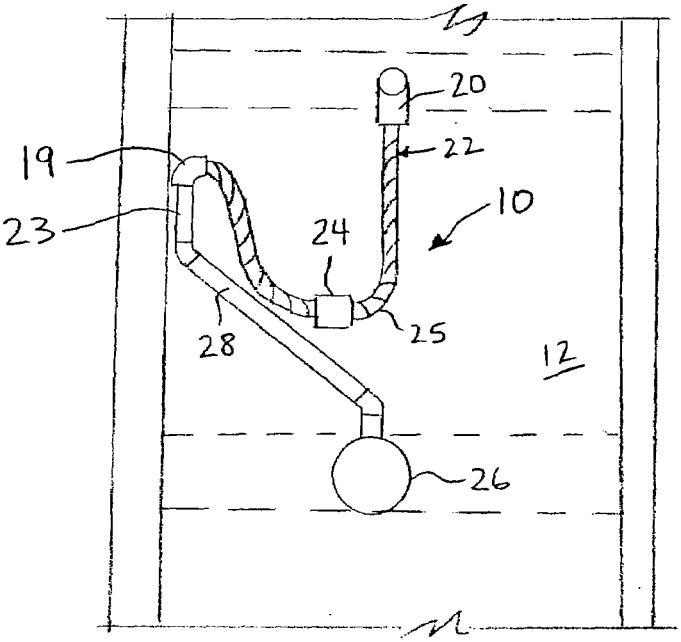
FIG. 3 is a rear view of the retractable showerhead.

FIGS. 1–3 depict a retractable showerhead 10 shown extending through a wall 12. A guide tube 16 passes through wall 12. Escutcheons 18 extend about tube 16 on apposite sides of wall 12. A corner piece 20 is attached on the end of tube 16 at the exterior side of the wall 12 and a mounting bracket 21 is attached on the end of the tube at the interior side of the wall. Flexible hose 22 is connected at one end to drop ear 19 which in turn is connected by a riser 23 to a water source which includes a supply valve 26 and piping 28. Flexible hose 22 is slidingly fitted through tube 16 and corner piece 20 and is connected to head part 11 of showerhead 10. Hose 22 is preferably formed of stainless steel flex hose.

A weight 24 is slidably carried by flexible hose 22 at the bottom of the loop 25 formed by the hose between drop ear 19 and tube 16 in a position that allows a defined length of hose 22 to be drawn through tube 16. Flexible hose 22 fits freely within tube 16 and corner piece 20 such that when head part 11 is removed from bracket 21, the tube may be pulled through wall 12 with the head part being in a use position. Weight 24 is heavy enough such that when head part 11 is replaced in a stored position into bracket 21, the weight which remains at the lowest point of loop 25 of hose 22 due to its slip fit upon the hose will cause the hose to retract through tube 16 and corner piece 19 into the wall 12. Bracket 21 includes a slot 27 which serves as a guide for hose 22 as it is extended and retracted.

Figure 4:
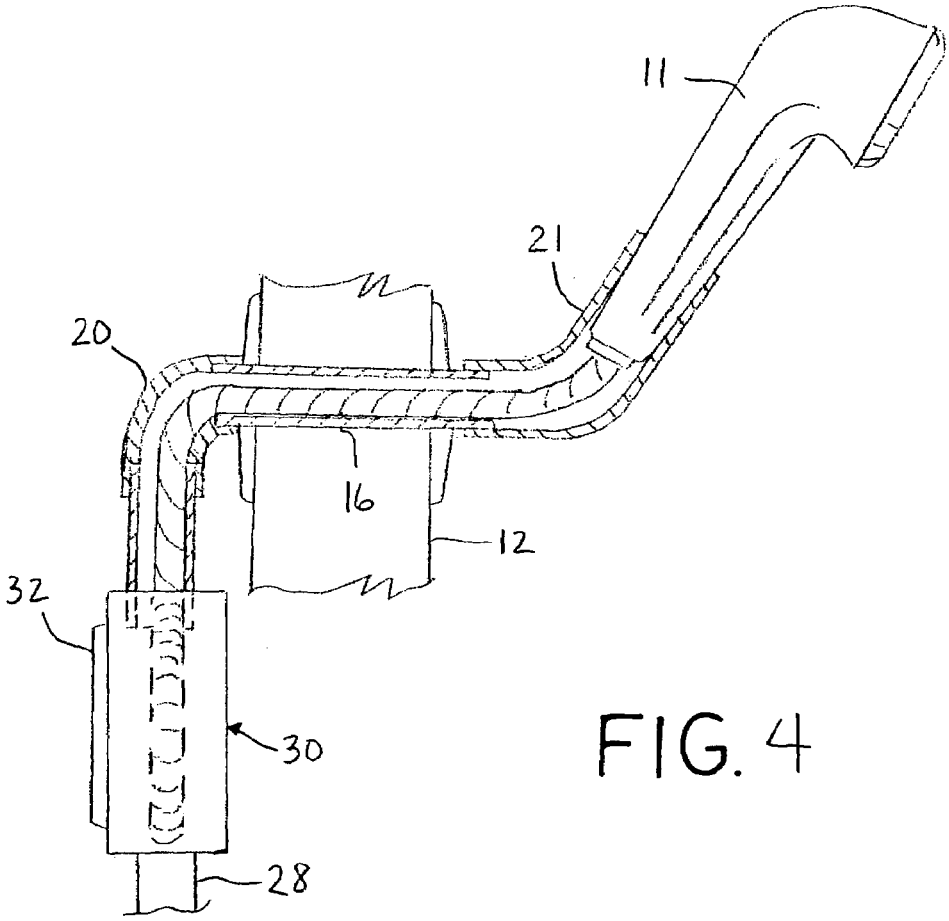
FIG. 4 shows an alternate embodiment of a retractable showerhead.
Figure 5:
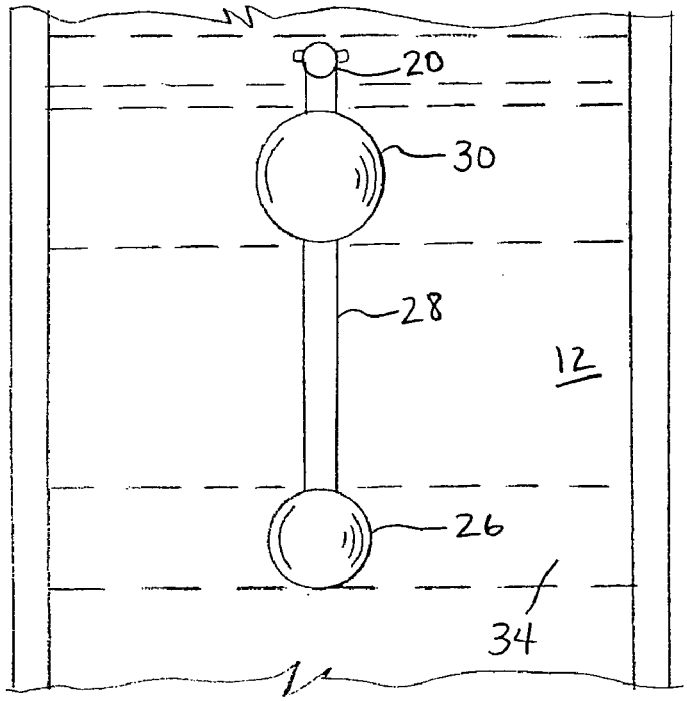
FIG. 5 is a rear view of the retractable showerhead of FIG. 4.
Figure 6:
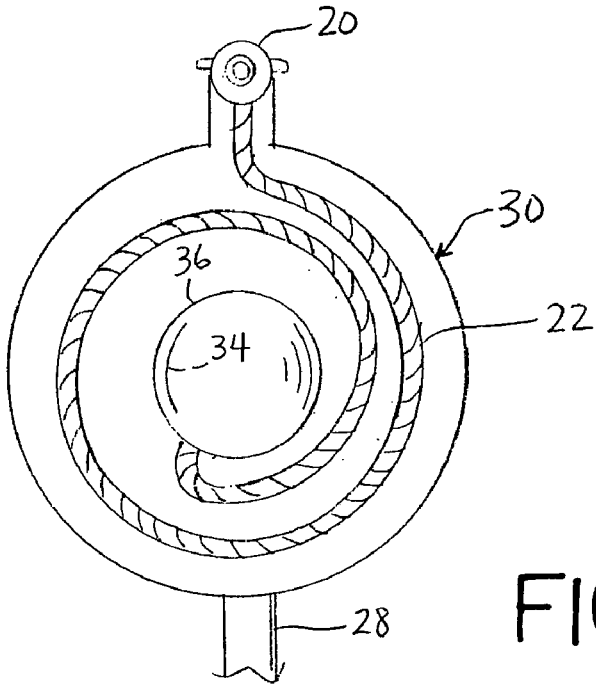
FIG. 6 is a detail of the retraction device used in the retractable showerhead of FIG. 4.

FIGS. 4–6 depict an alternative embodiment of the retractable showerhead 10, which includes a coiler 30 on the exterior of wall 12. In this alternative, flexible hose 22 is run through tube 16 and corner piece 20 in wall 12 and is wound around a reel 25 within coiler 30. Coiler 30 includes a bracket 32 for mounting the coiler to wall 12 or a backing mount 34. A liquid tight rotatable coupler is connected between piping 28 which is connected to water supply valve 26 and the end of hose 22 at reel 25. Coiler 30 includes an internal helical spring 34 which is tightened when the hose is pulled from the wall and the reel 36 caused to be rotated as head part 11 is pulled away from wall 12 into its use position. As head part 11 is replaced in bracket 21, spring 34 causes reel 36 to reverse rotate to recoil hose 22 about the reel and into coiler 30.

The above description is to enable a person skilled in the art to make and use the invention described, and does not include all obvious variations or uses for the invention, all of which are expressly included herein.

I claim:

1. A retractable showerhead for use in a shower stall having a wall, said showerhead comprising a head part for emitting water into said stall, a hose connected at one end to said head part and connected at its other end to a water source, said water source being at one side of said wall, a mounting bracket at the opposite side of said wall, said hose extending freely through said wall and forming a depending loop between said water source and said wall when said head part is supported by said bracket, a weight freely slidable on said hose located at said loop and constituting means for sliding along and pulling on said hose when said head part is moved from a use position in which the hose extends from said opposite side of said wall into a stored position in which said hose is recessed within said wall at said one side of the wall, said bracket being slotted so as to define a channel means for guiding the movement of said hose as said head part moves from its said storage position into its said use position.

* * * * *